US006547170B2

(12) United States Patent
Byrd et al.

(10) Patent No.: US 6,547,170 B2
(45) Date of Patent: Apr. 15, 2003

(54) ROTARY GRANULAR MATERIAL CUTTERS

(75) Inventors: Joseph Alfred Byrd, Cedar Rapids, IA (US); David LaKose, Cedar Rapids, IA (US)

(73) Assignee: Quaker Oats Company, Chicago, IL (US)

( * ) Notice: Subject to any disclaimer, the term of this patent is extended or adjusted under 35 U.S.C. 154(b) by 0 days.

(21) Appl. No.: 10/059,936

(22) Filed: Jan. 31, 2002

(65) Prior Publication Data

US 2002/0092937 A1 Jul. 18, 2002

Related U.S. Application Data

(63) Continuation of application No. 09/564,942, filed on May 5, 2000, now Pat. No. 6,431,479.

(51) Int. Cl.[7] ..... B02C 18/18

(52) U.S. Cl. ..... 241/30; 241/86.1; 241/88.1; 241/294

(58) Field of Search ..... 241/30, 6, 9, 13, 241/80, 97, 88.1, 89.3, 294, 86.1

(56) References Cited

U.S. PATENT DOCUMENTS

| | | | |
|---|---|---|---|
| 189,399 | A | 4/1877 | Tompkins |
| 208,970 | A | 10/1878 | Eberhard et al. |
| 241,249 | A | 5/1881 | Thorp |
| 279,594 | A | 6/1883 | Pryor |
| 307,882 | A | 11/1884 | Swingle |
| 4,474,336 | A | 10/1984 | Fleming |
| 4,802,631 | A | 2/1989 | Arasmith |
| 5,484,110 | A | 1/1996 | Doppstadt |

OTHER PUBLICATIONS

ArrowCorp Promotional Literature (1), 1999, all pages, various earlier improvements to the "Kipp Kelly" cutters.
ArrowCorp Promotional Literature (2), 1999, p. 6, describing interior drum baffles.

*Primary Examiner*—Mark Rosenbaum
(74) *Attorney, Agent, or Firm*—Glenn Johnson; Douglas J. Stilwell

(57) ABSTRACT

The present invention is an improved rotary granular material cutting apparatus and knife blade assembly. The apparatus comprises a perforated drum that may receive granular material into its interior. The grains of material extend through perforations in the spinning drum where they encounter a series of knife blades. The blades are arranged to form angles of contact with tangents to the spinning drum. Those angles of contact are steeper on the side regions of the spinning drum tan on the bottom regions. The apparatus also includes a grooved interior baffle to disburse input material within the drum, and knife-mounting wedges that include toe or base stops to help secure knife it blades in arrangement about the drum.

8 Claims, 5 Drawing Sheets

PRIOR ART

ROTARY GRANULAR MATERIAL CUTTERS

RELATED APPLICATIONS

This application is a continuation application of U.S. application Ser. No. 09/564,942 filed on May 5, 2000, now U.S. Pat. No. 6,431,479, entitled "Rotary Granular Material Cutters".

BACKGROUND OF THE INVENTION

The present invention relates generally to the field of grain processing and specifically to an apparatus and method for cutting "groats" (de-hulled oats), other grains, or other granular material. Finely cut groats commonly are used for the production of "quick-oats" and other oat-based food products. Because finely cut groats have a greater surface area to volume ratio than more coarsely cut groats, more surface area is available for a given volume of groats. This increased surface area allows greater contact between, for example, boiling water and the groats. As a result, the moistening and cooking of finely cut groats may be performed in a relatively short time, hence the name "quick-oats". The production of quick-oats, in addition to other types of oat-based food products, therefore depends upon the production of finely cut groats.

The basic technology for cutting granular material applies to a variety of grains for a variety of products. Each grain product and each different producer of grain products may require grain to be cut to a different degree of fineness. The present invention relates specifically to improvements that may increase grain cutting efficiency for grain cutting in general, for different grains and for different levels of desired fineness. Therefore, although the examples detail the fine-cutting of groats, it will be apparent to one skilled in the art that the present invention may be applied to different materials and to make coarser, or finer, end products.

The prior art technology for cutting groats includes the use of a drum that spins on a horizontal axis and contains a plurality of perforations in its sidewall. The perforations in the spinning drum's sidewall allow groats to extend from the drum interior at least partially through the sidewalls where they may contact one or a series of stationary cutting blades that are arranged in close proximity to the drum sidewall exterior. U.S. Pat. No. 307,882 (the '882 patent) discloses a typical prior art groat cutting apparatus that employs this technology. The common "Kip Kelly" type cutter (developed many years ago and currently marketed by Arrow Corp. of Winnipeg Canada) also employs this basic technology. Other examples of prior art groat cutting devices include U.S. Pat. Nos. 208,970 (the '970 patent), 241,249 (the '249 patent), and 279,594 (the '594 patent).

As disclosed in the '882 patent, the rotary groat cutting apparatus receives groats into the interior of the perforated, spinning drum. The spinning drum is nested in a blade assembly that consists of a series of four knife blades separated by grain support surfaces. Groats of grain extend through the perforations and contact either a blade or a support surface between the blades. The spinning drum causes the groats to ride upon the support surfaces until the groats encounter a cutting blade. When a groat is cut sufficiently fine, its cut portions exit the drum completely, and another groat extends through the perforation. The apparatus disclosed in the '882 patent, therefore, utilizes only a fraction of the blade assembly for actual cutting.

The '882 patent also discloses a separate, spinning cylinder or "pinwheel" located on the exterior of the spinning drum. The pinwheel contains pins aligned with passing perforations in the drum. These pins clear the perforations of groat portions or other obstructions. In the '882 patent, separate gear mechanisms on the drum and pinwheel work cooperatively to rotate the drum and pinwheel. Alternatively, the pinwheel may serve as the source of rotation for the drum. Because the spinning drum and pinwheel spin cooperatively, it is important to maintain precise alignment of the pins with the drum perforations to avoid damage to the drum or pins and to avoid the loss of metal from the drum or pins into the groat stream.

A primary cause of the loss of alignment between the pinwheel pins and the drum perforations is contamination of the pinwheel assembly with dust from the groat cutting process (which inherently produces a great deal of dust). Over time, this dust tends to work its way into spaces between machine components. The '882 patent discloses a solid pinwheel assembly that consists of one cylinder having a plurality of pins that extend from its perimeter. This solid cylinder design is only minimally susceptible to dust because it has few seams into which dust may migrate. Unfortunately, this solid cylinder design demands repair or replacement of the entire pinwheel cylinder when only one or a few pins are damaged. Therefore, a more typical pinwheel design consists of a series of parallel rings. Parallel ring construction allows removal and replacement of a damaged ring (only a portion of the pinwheel) when only one or a few pins become damaged. Unfortunately, this advantageous design itself leads to pin misalignment as seams are inherent in the parallel ring construction, and migrating dust may force the parallel rings apart. There is, therefore, a need for a pinwheel assembly improvement to prevent the migration of dust into the pinwheel assembly while maintaining the advantage of a parallel ring construction.

The knife blades mounted generally below and near the exterior of the spinning drum also require periodic replacement or maintenance and they are typically mounted individually upon a knife mounting assembly. As discussed, the '882 patent discloses the use of four independent knife blades separated by a casing upon which protruding groat portions may "ride" as the drum spins. The '249 patent discloses the use of a plurality of knife blades wherein the blades are "substantially tangential" to the spinning drum. Similarly, the common "Kip Kelly Cutter" utilizes a series of knife blades that form a "nest" generally around the bottom half, or a portion of the bottom half of the spinning drum. Over time, these knife blades may loosen or slip and cause damage to the rapidly spinning drum and blades.

The knife blades and pinwheel assemblies, of course, must be replaced periodically. However, when blades slip or pins become misaligned, contact with the rapidly spinning drum needlessly cuts short the "life" of these components. In addition, damage to the drums demands repair or replacement of the drums, which are themselves expensive, precision-engineered components. The replacement of drums, pinwheels, or blades necessarily demands lost production associated with each stopped machine and labor expenses associated with the replacement of parts. There is, therefore, a need for a means to prevent or minimize instances of contact between the blades and the spinning drum as well as a means to prevent the misalignment of pins and drum perforations.

In prior art groat cutting devices, even when a series of knife blades were employed, most cutting was performed by only a limited number of blades located at an effective cutting region generally at the bottom or extreme bottom of the knife blade assembly. This effective cutting region varied depending on the type of grain being cut and the desired level of fineness or coarseness. The focus of cutting in an effective region occurs because gravity is the primary force that draws groats to the perimeter of the rotating drum, augmented only in small part by centrifugal force. Therefore, gravity makes groats available for cutting along a majority of the bottom of the spinning drum during operation. It is only in the effective cutting region at the bottom of the profile where the pull of gravity acts to move the grains directly into the perforations. At side regions, the pull of gravity aids to a lesser extent and groats are less effectively cut. Therefore, there is a need for an improved rotary granulator that more effectively utilizes knife blades mounted beyond the limited effective cutting region currently found at the bottom or extreme bottom of the spinning drums.

Finally, groat cutting efficiency is decreased by groats that enter the interior of the spinning drum but fail to disburse evenly throughout the drum so as to protrude through the perforated sidewall at all locations along longitudinal expanse of the sidewall. In general, for a given flow rate of groats, there is a drum retention time that represents the average time spent in the interior of the spinning drum for a groat. This retention time is roughly proportionate to the volume of the spinning drum occupied by grains during operation, divided by the volumetric flow rate of groats through the machine. The groat flow rate may be maximized, and the groat retention time may be minimized, by minimizing the number of "empty" perforations that pass knife blades during each rotation of the drum. There is therefore a need for an improved rotary granulator that minimizes drum retention time and maximizes groat flow rate by more effectively utilizing all available sidewall perforations through each rotation of the drum.

SUMMARY OF THE INVENTION

The present invention is an improved grain cutting apparatus comprised of a perforated drum that spins on a horizontal axis. A pinwheel assembly spins cooperatively with the perforated drum, and pins on the pinwheel assembly engage and disengage drum perforations as the drum and assembly spin. Groats are received into the interior of the perforated drum and a grooved baffle in the interior of the perforated drum directs groats towards passing perforations in the drum sidewall. These groats eventually reach the sidewall and extend partially through the perforations. The grooved baffle prevents the incoming groat stream from remaining in a focused stream, and instead diffuses the stream to direct groats towards perforations along the entire length of the sidewall.

The protruding groats contact one or a series of stationary knife blades. The knife blades are mounted so that the cutting edge of each blade forms an identifiable angle of contact with a line tangent to the drum sidewall at the location of the blade. Different angles of contact are employed for blades at different locations on the blade assembly. This varied knife blade profile extends the effective cutting region beyond the traditional bottom region of the assembly to include blades along the rising sides of the assembly. This variation in the angles within the blade assembly allows cutting to occur over a greater region of the blade assembly and dramatically enhances groat cutting throughput and efficiency.

The present invention also incorporates improved knife blade supports with toe stops to further secure the knife blades and prevent the blades from slipping and contacting the spinning drum.

DESCRIPTION OF THE PREFERRED EMBODIMENT OF THE INVENTION

Figure 2:
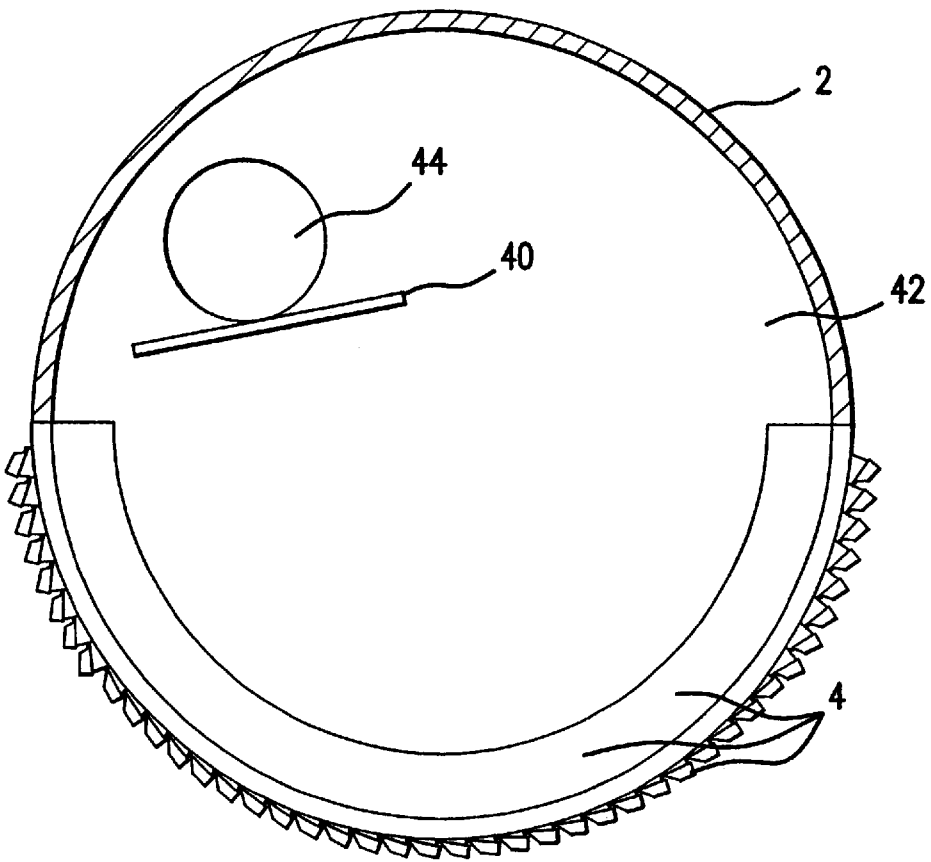
FIG. 2 is a cut-away end view of a perforated drum with a grooved channel.
Figure 1:
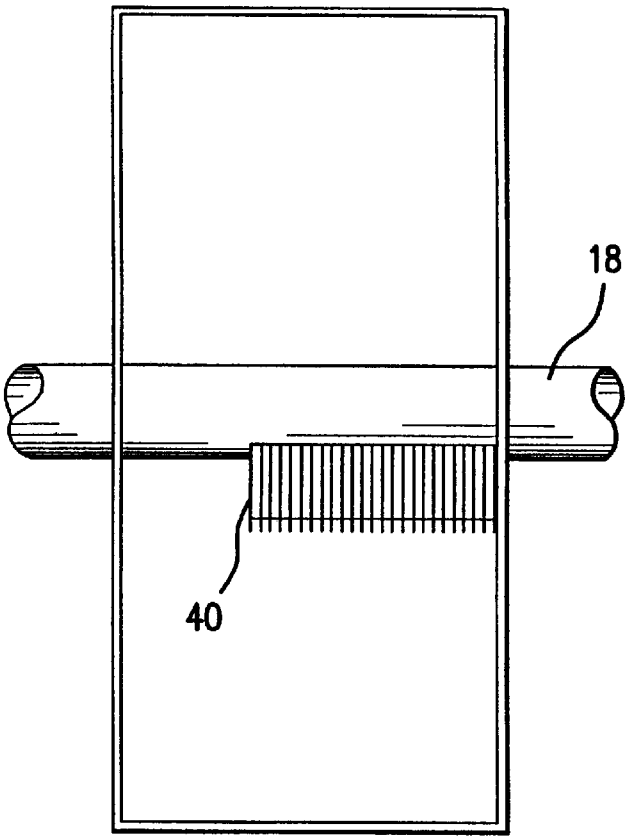
FIG. 1 is a cut-away top view of a perforated drum with a grooved channel.
Figure 3:
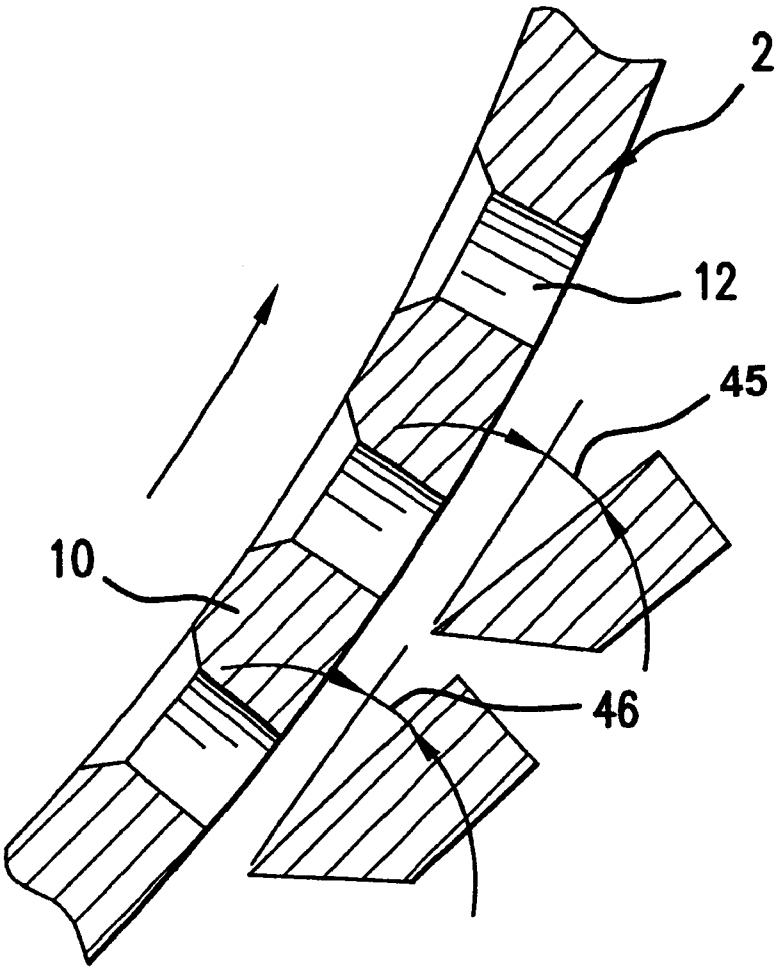
FIG. 3 is a detailed cut-away cross-sectional view of a perforated drum sidewall and knife blades.
Figure 4:
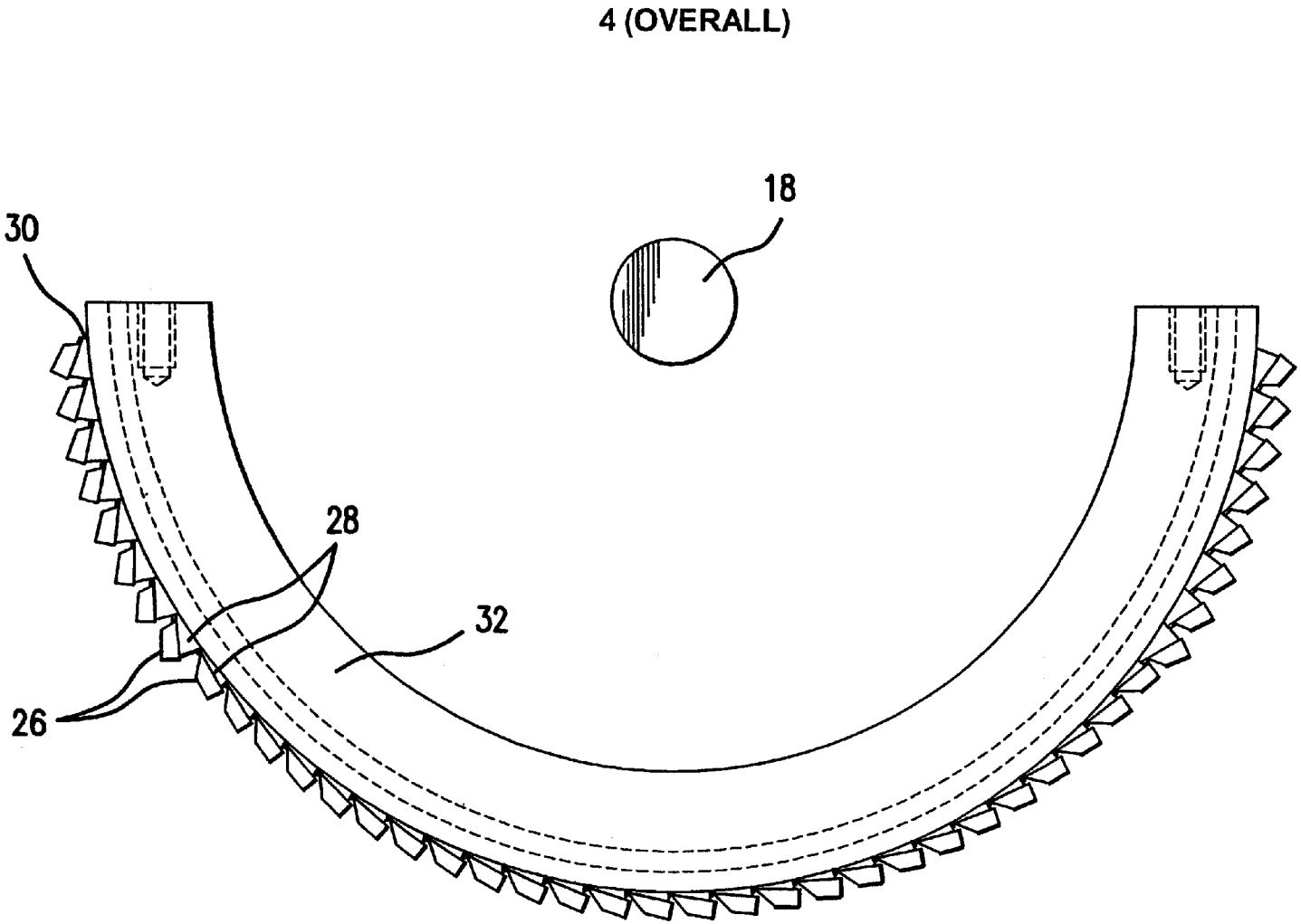
FIG. 4 is a cut-away cross-sectional view of a knife blade assembly.
Figure 5:
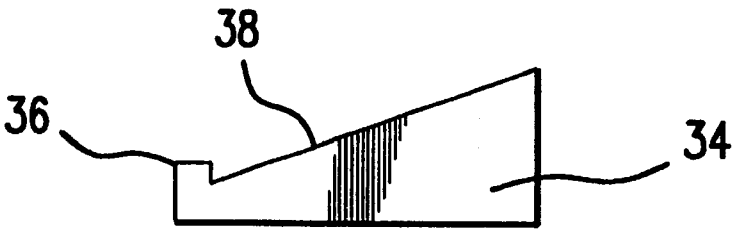
FIG. 5 is a side view of a knife blade support with toe stop.
Figure 7:
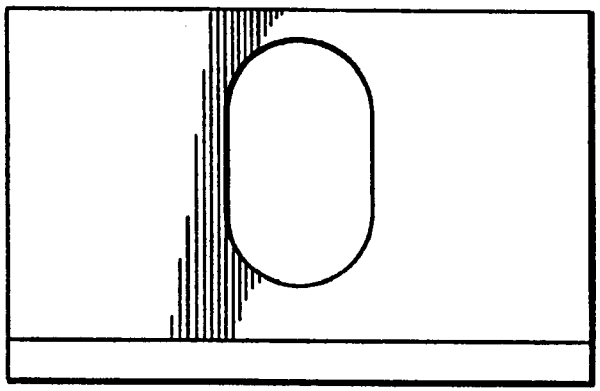
FIG. 7 is a top view of a knife blade support with toe stop.
Figure 6:
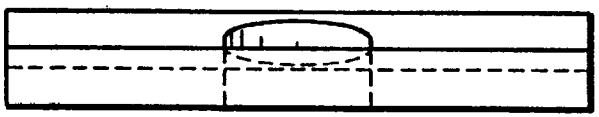
FIG. 6 is a front end view of a knife blade support with toe stop.
Figure 8:
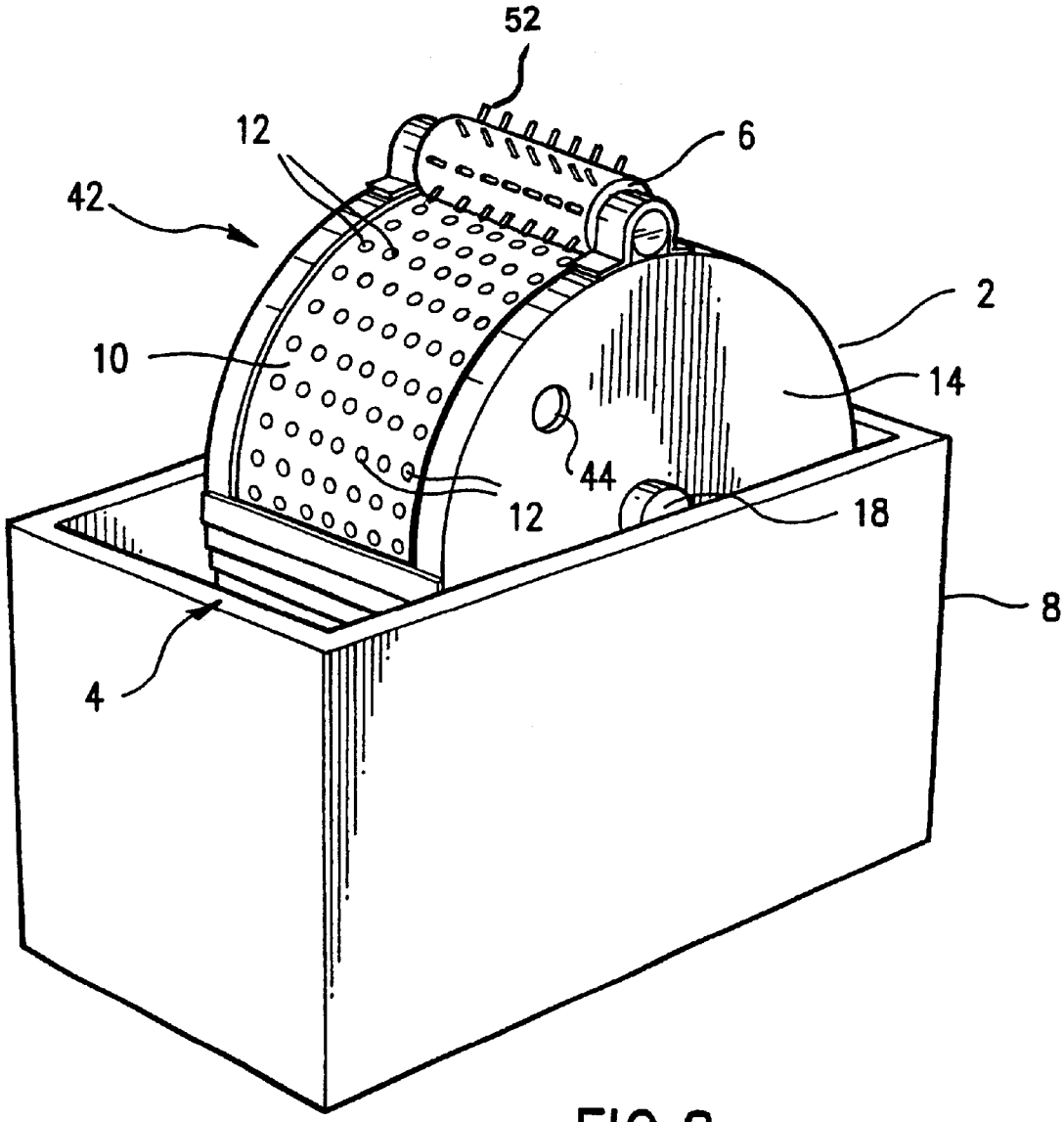
FIG. 8 is a perspective view of a prior art groat cutter.

The preferred embodiment of the present invention is comprised of a perforated drum 2, a knife blade assembly 4, a pinwheel assembly 6, and a support frame assembly 8. The perforated drum 2 is comprised of a drum sidewall 10 having a plurality of perforations 12 appropriately sized to allow groats to extend therethrough. Perforations 12 ideally comprise tapered perforations having a broader diameter opening on the interior side of the drum sidewall 10 than on the exterior side of the drum sidewall 10. This tapered perforation design helps to facilitate the entry of groats into the perforations. The perforated drum 2 is also comprised of drum end walls 14,42 generally perpendicular to the drum sidewall 10. At least one of the drum end walls 14 is a non-rotational drum end wall 42 that remains fixed to allow groats to flow into the perforated drum interior through a stationary inlet 44.

The perforated drum 2 is positioned in a support frame assembly 8. The support frame assembly 8 holds the drum in a position to place the generally cylindrical drum's longitudinal axis of rotation in a generally horizontal position The drum is held preferably by means of a horizontal axle 18 that extends through the drum end walls 14 and the interior of the drum. The drum may be supported by other, alternative means such as exterior drum end wall supports 20 that engage the drum end walls 22 to support the drum along a central axis of rotation, or wheel assemblies that may support the drum or support and drive the drum's rotation through contact with the drum exterior.

The support frame assembly 8 may be of any convenient height, or it may be designed for integration with preexisting support structures in a milling facility. In the preferred embodiment, the support frame assembly 8 supports the perforated drum 2 and knife blade assembly 4 at a height convenient for inspection by a person of average height. The preferred support frame assembly 8 also engages a cutter cover 24 to control the release of grain dust into the cutting room environment and to serve as a shield to prevent accidental contact with the spinning drum or stationary blades. The cutter cover is preferably of a design that allows convenient viewing of the perforated drum 2.

The preferred knife blade assembly 4 is comprised of a plurality of knife blades 26 mounted upon knife holders 28 that typically comprise mounting wedges. The knife holders 28 include toe stops 30 in addition to a means, preferably mechanical, such as a tee bolt, for affixing the knife blade 26 to the knife holders 28. The knife holders 28 in turn are affixed to a knife blade mounting frame 32 that follows the shape and curvature of the drum sidewall 10. When knife holders 28 are affixed to the knife blade mounting frame 32 on opposite edges of the drum sidewall 10 and knife blades 26 are attached thereto, the knife blades 26 span the perforated drum sidewall 10 separated therefrom by a short clearance.

The knife holders 28 are comprised of a wedge portion 34 with a toe stop 36 thereon. The wedge portion 34 has a wedge portion top face 38 that forms an angle of contact 44,46 with a line that is generally tangent to the perforated drum sidewall 10 at the location of the knife holder 28. In the preferred embodiment, knife holders 28 placed along the bottom portion of the knife blade mounting frame 32 include a wedge portion top face 38 that forms an angle of contact of about 9.75°. Knife holders 28 placed higher on the knife blade support structure 32 include a wedge portion top face 38 that forms an angle of contact 44 of about 17.5°. These angles are, of course, merely the presently preferred embodiment. It will be understood by one of ordinary skill in the art that the present invention relates generally to the use of multiple angles of contact wherein the angle of contact 46 is generally less for blades located in lower mounting frame 32 positions than the angle of contact 44 in higher regions on the knife assembly. Further, although the presently preferred embodiment employs only two discrete angles of contact, the present invention also encompasses the use of a plurality or a general progression of angles.

To further enhance the efficiency of the cutter, the perforated drum 2 interior contains a grooved baffle 40 affixed to the non-rotating drum end wall 42. The grooved baffle 40 is located in a position relative to the incoming groat stream to receive the stream and diffuse its focused profile. In the presently preferred embodiment, this location is generally above the perforated drum's axis of rotation. Further, the grooved baffle 40 is angled generally downward and towards the drum sidewall so that incoming groats are directed towards the sidewall perforations 12 at a location generally near the first knife blade in the series of blades 28. The grooved baffle 40 more effectively aligns groats with the sidewall perforations than does the known, non-grooved baffle, or baffle-less drum configuration. Further, the grooved baffle causes the incoming stream of groats to disperse along a greater portion of the drum's width than a non-grooved baffle because the grooves prevent the stream of groats from remaining condensed along a tight path. By distributing the groats over a greater length of the drum cylinder and aligning the groats for entry to the perforations, more of the perforations in the sidewall are exposed to properly align input groats for cutting.

A pinwheel 48 is located on the exterior of the drum sidewall 10 at a top location, or an alternative location to which access is not otherwise obstructed by the mounting frame 32. The pinwheel 48 comprises a series of parallel disks or rings 50 each having pins 52 that extend radially therefrom and that align with drum sidewall perforations 12 as the pinwheel 48 and drum 2 spin in cooperation. The pins 52 of the pinwheel 48 thus clear drum sidewall perforations 12 of granular material that fails to exit through the normal cutting process. In the preferred embodiment, the cylinder includes bushings to prevent the migration of dust between the parallel rings or disks.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

We claim:

1. A knife blade mounting assembly for use with a rotary drum to cut granular material, said knife blade mounting assembly comprising:

a mounting frame defining a substantially semi-circular profile, said profile having a center region bounded by a first end region and a second end region;

a plurality of knife blades combined with the mounting frame, each of said knife blades defining a plane, and each of said planes intersecting a line tangent to the mounting frame semi-circular profile at the location of the knife blade to form an angle of intersection, said angles of intersection being generally greater at locations on at least one of the mounting frame end regions than at locations on the mounting frame center region.

2. The knife blade mounting assembly of claim 1 wherein the angles of intersection in the central region are about 9.75 degrees.

3. The knife blade mounting assembly of claim 1 wherein the angles of intersection in the end regions are about 17.5 degrees.

4. The knife blade mounting assembly of claim 1 wherein:

the mounting frame comprises two parallel rails.

5. A method for cutting a grain of material comprising, releasably securing a food grain with at least a portion of the grain being exposed;

causing the exposed portion of the releasably secured grain of material to move along a path relative to a plurality of cutting edges, the cutting edges being disposed to present a plurality of angles of contact between the cutting edges and the path.

6. The method of claim 5 for cutting a grain of material wherein:

the food grain is releasably secured within an opening formed in the wall of a drum.

7. The method of claim 6 for cutting a grain of material wherein:

the path follows a curve defined by spinning the drum.

8. The method of claim 7 for cutting a grain of material wherein:

the food grain is cut by the plurality of cutting edges which are arranged in a cutting edge assembly such that there exists a central region and an end region, the angle of contact being greater at the end region than at the central region.

* * * * *